US009375055B2

(12) United States Patent
Tedder

(10) Patent No.: US 9,375,055 B2
(45) Date of Patent: Jun. 28, 2016

(54) CONVERTIBLE GARMENT SYSTEMS, AND RELATED DEVICES AND METHODS

(76) Inventor: Amy L. Tedder, Colfax, NC (US)

( * ) Notice: Subject to any disclaimer, the term of this patent is extended or adjusted under 35 U.S.C. 154(b) by 998 days.

(21) Appl. No.: 13/248,713

(22) Filed: Sep. 29, 2011

(65) Prior Publication Data

US 2012/0094576 A1 Apr. 19, 2012

Related U.S. Application Data

(60) Provisional application No. 61/388,198, filed on Sep. 30, 2010.

(51) Int. Cl.

| | |
|---|---|
| ***A41C 3/00*** | (2006.01) |
| ***A44B 11/04*** | (2006.01) |
| ***A41F 15/00*** | (2006.01) |
| ***A44B 11/12*** | (2006.01) |
| *A41D 7/00* | (2006.01) |
| *A41D 15/00* | (2006.01) |
| *A41F 15/02* | (2006.01) |

(52) U.S. Cl.

CPC ..... *A44B 11/04* (2013.01); *A41F 15/002* (2013.01); *A44B 11/12* (2013.01); *A41C 3/00* (2013.01); *A41D 7/00* (2013.01); *A41D 15/00* (2013.01); *A41F 15/02* (2013.01); *Y10T 24/4012* (2015.01); *Y10T 24/4019* (2015.01); *Y10T 24/4021* (2015.01); *Y10T 24/4023* (2015.01); *Y10T 24/4044* (2015.01)

(58) Field of Classification Search

CPC ..... A41F 1/006; A41F 15/00; A41F 15/002; A41F 15/02; Y10T 24/4021; Y10T 24/4012; Y10T 24/4023; Y10T 24/4019; Y10T 24/4044; A41C 3/06

USPC ..... 24/315, 318, 136 R, 182, 198, 316, 3.12, 24/350, 507; 450/86–88, 1; 2/459, 44–45, 2/92, 323, 336–338, 302, 305, 324, 313, 2/314

See application file for complete search history.

(56) References Cited

U.S. PATENT DOCUMENTS

| | | | | | |
|---|---|---|---|---|---|
| 911,783 | A * | 2/1909 | Traver | A41F 11/02 | 2/336 |
| 1,616,267 | A * | 2/1927 | Laird | A41F 15/002 | 2/323 |
| 1,689,977 | A * | 10/1928 | Stirton | 24/168 | |
| 1,814,451 | A * | 7/1931 | Neveu | A41D 7/00 | 2/231 |
| 1,926,078 | A * | 9/1933 | Yonts | A41F 1/006 | 450/86 |
| 1,936,127 | A * | 11/1933 | Dunlevy | A41F 15/002 | 2/323 |
| 2,099,199 | A * | 11/1937 | Devendor | A44B 11/04 | 2/268 |
| 2,257,494 | A * | 9/1941 | Brown | A41F 15/002 | 2/73 |

(Continued)

FOREIGN PATENT DOCUMENTS

| | | | |
|---|---|---|---|
| DE | 29915766 U1 | * | 3/2000 |
| GB | 2404327 A | * | 2/2005 |

*Primary Examiner* — Andrew W Collins
*Assistant Examiner* — Brieanna Szafran
(74) *Attorney, Agent, or Firm* — MacCord Mason PLLC

(57) ABSTRACT

Convertible garment systems and related devices and methods are shown and described. In one example, a convertible garment system includes a bathing suit and a pair of detachable-strap-interfaces, each configured to removably connect to the bathing suit's lower straps, and removably connect to the bathing suit's upper straps, thereby creating a second configuration for the pair of upper straps. In another example, a device includes at least one detachable-strap-interface for converting a bathing suit.

14 Claims, 19 Drawing Sheets

(56) References Cited

U.S. PATENT DOCUMENTS 2,278,153 A * 3/1942 Shaulson ..... A44B 11/04 24/200
2,363,017 A * 11/1944 Plehn ..... A41F 1/006 450/77
2,535,641 A * 12/1950 Levy ..... A41F 1/006 24/301
2,595,139 A * 4/1952 Hart ..... A41F 15/002 2/323
2,984,879 A * 5/1961 Budd ..... A41F 15/02 2/73
3,161,931 A * 12/1964 Zif ..... A41F 1/006 24/200
3,222,688 A * 12/1965 Rosenzweig ..... A41F 15/002 2/323
3,251,108 A * 5/1966 Harrison ..... A41F 15/002 24/166
3,311,112 A * 3/1967 Murray ..... A41F 1/006 450/1
3,506,014 A * 4/1970 Sorenson ..... A41C 3/0021 450/60
3,623,487 A * 11/1971 Chiu ..... A41C 3/0021 2/323
6,186,863 B1 * 2/2001 Kim ..... A41F 15/002 450/1
6,240,560 B1 * 6/2001 DeCaro ..... A41B 9/002 2/67
8,075,369 B2 * 12/2011 Hendrickson ..... A41C 3/0028 450/86
2002/0022434 A1 * 2/2002 Plourde ..... A41F 1/006 450/86
2002/0077029 A1 * 6/2002 Fildan ..... A41F 1/006 450/86
2003/0003844 A1 * 1/2003 Jones ..... A41F 15/002 450/88
2004/0006853 A1 * 1/2004 Yang ..... 24/197
2008/0189912 A1 * 8/2008 Grunig ..... A41B 13/10 24/3.12
2009/0047866 A1 * 2/2009 Smith ..... A41F 15/002 450/88

* cited by examiner

CONVERTIBLE GARMENT SYSTEMS, AND RELATED DEVICES AND METHODS

RELATED APPLICATIONS

This application claims priority to Provisional Application No. 61/388,198 filed on Sep. 30, 2010.

FIELD OF TECHNOLOGY

The current disclosure relates generally to convertible garment systems and, more particularly, to convertible systems designed, for example, to improve the fit or style of a garment, e.g., a bathing suit.

BACKGROUND

FIG. 1 illustrates a known example of a bathing suit 2. Suit 2 includes a pair of breast cups. Breast cups 4 may be connected on their front by a strap, e.g., strap 6, or by an integral construction or some other piece of fabric.

A pair of upper straps 10*a* and 10*b* are connected to the breast cups and extend upwardly for connecting behind the neck of a user. Breast cups are considered to be inclusive of any material for covering the breasts, e.g., single layer fabric cut to cover the breast may be considered a breast cup. Connection may be achieved in a variety of ways, e.g., clip, bow or knot 10*c*.

A pair of lower straps 12*a* and 12*b* are connected to the pair of breast cups and extendable laterally for connecting behind the back of the user. Connection may be achieved in a variety of ways, e.g., clip, bow, knot, integral, etc.

The described configuration of how the suit's breast cups are secured to a user may be considered a first configuration. In first configurations, the user's neck may be considered to support the load of the user's breast. Applicant believes that with some suits, for example, the first configuration may create excessive load bearing or undesirable pressure on the neck, e.g., if suits or worn too long, if straps are too thin, if the load is too large, etc. Excessive load bearing may result in a variety of problems, including, inter alia, headaches. Further, the acute pressure created by clip or knot 10*c* on the user's spine or neck may contribute to headaches, nerve, circulation, or other problems. Further, while the suit 2 is illustrated a bikini, e.g., having a separate bottom 14, suits of other constructions, e.g., one piece, may be considered to have a first configuration as disclosed herein.

It is to any combination of these or additional problems that the current disclosure is directed.

SUMMARY

The current disclosure is directed to a variety of systems, devices, and methods. In one example, a convertible garment system includes a garment and at least one detachable-strap-interfaces (DSI) configured to removably connect to the garment's lower straps and removably connect to the garment's upper straps, thereby creating a second configuration for the pair of upper straps. The garment may be, for example, a bathing suit or similar garment having a halter top.

In one example, a device includes a detachable-strap-interface (DSI). The DSI comprises a buckle-end configured to attach to at least one of a garment's upper straps and a channel-portion configured to attach to at least one of a garment's lower straps. DSIs may also be used in combination with other garments having upper straps for connecting behind the neck of a wearer.

In one example, a method includes a method of converting a bathing suit to a second configuration. In this example, the method comprises obtaining a bathing suit designed to have a first configuration, attaching one of the suit's pair of upper straps to a first detachable-strap-interface (DSI); and attaching the first DSI to at least one of the pair of lower straps. Methods also include performing similar steps with other garments.

A further example includes a method of enabling a convertible garment system, the method having the steps of:

obtaining a garment configured to be worn on an upper torso area of a wearer having a pair of upper shoulder straps connected to the garment and extending upwardly for connecting the upper shoulder straps to one another adaptively to be behind a neck of the wearer in a first configuration, a pair of lower back straps connected to the garment and extending laterally for connecting at a position adaptively below the neck and behind a back of the wearer;

converting the garment from the first configuration with the pair of upper shoulder straps securing to each other behind the wearer's neck to a second configuration wherein each of the upper shoulder straps unconnect from each other to extend across the wearer's shoulders to secure to at least one detachable-strap-interface and to the pair of lower back straps at a position below the neck and behind the back of the wearer, the second configuration reducing load bearing and acute pressure on the neck of the wearer created by the pair of upper shoulder straps in the first configuration, the at least one detachable-strap-interface in the second configuration comprising:

a base plate receiving one of the pair of upper shoulder straps and one of the pair of lower back straps of the convertible garment system, the base plate including:

a buckle-end defining an upper aperture and a lower aperture, the upper and lower apertures separated by an upper arm and framed on each side by side arms, wherein the upper aperture receiving said one of the pair of upper shoulder straps of the garment adaptively from one of the shoulders of the wearer, a lower arm situated below the lower aperture and between the side arms; and a channel-portion defining a finger extending from at least one of the side arms, an open aperture separating the finger from the lower arm, wherein the open aperture receiving said one of the pair of upper shoulder straps of the garment from the upper aperture and the lower aperture receiving said one of the pair of upper shoulder straps of the garment from the open aperture;

a channel arm including:

a channel shelf, and a channel aperture within the channel shelf shaped to accept the finger of the channel-portion, and wherein the channel arm mating with the base plate by an interface between the finger and the channel aperture by the channel aperture receiving the finger of the channel-portion, the channel arm having a length extending above the lower arm of the buckle end towards the lower aperture upon the channel arm mating with the base plate creating a channel passageway for securing said one of the lower back straps, the channel passageway forming above the channel shelf and between the channel arm and the lower arm;

receiving said one of the lower back straps between the channel arm and the lower arm through the channel passageway, the channel shelf capable of applying upward pressure to said one of the lower back straps via the channel passageway.

The method also including locking the channel arm in place by interfacing a projection inside the channel aperture with a recess on the finger, including attaching a face plate to the base plate, and aligning one of the side arms of the base plate with a set of projections extending from the face plate.

The above summary was intended to summarize certain embodiments of the present disclosure. Systems, devices and methods will be set forth in more detail in the figures and detailed description below. It will be apparent, however, that the detailed description is not intended to limit the present invention, the scope of which should be properly determined by the appended claims.

DETAILED DESCRIPTION OF EXAMPLES

Figure 1:
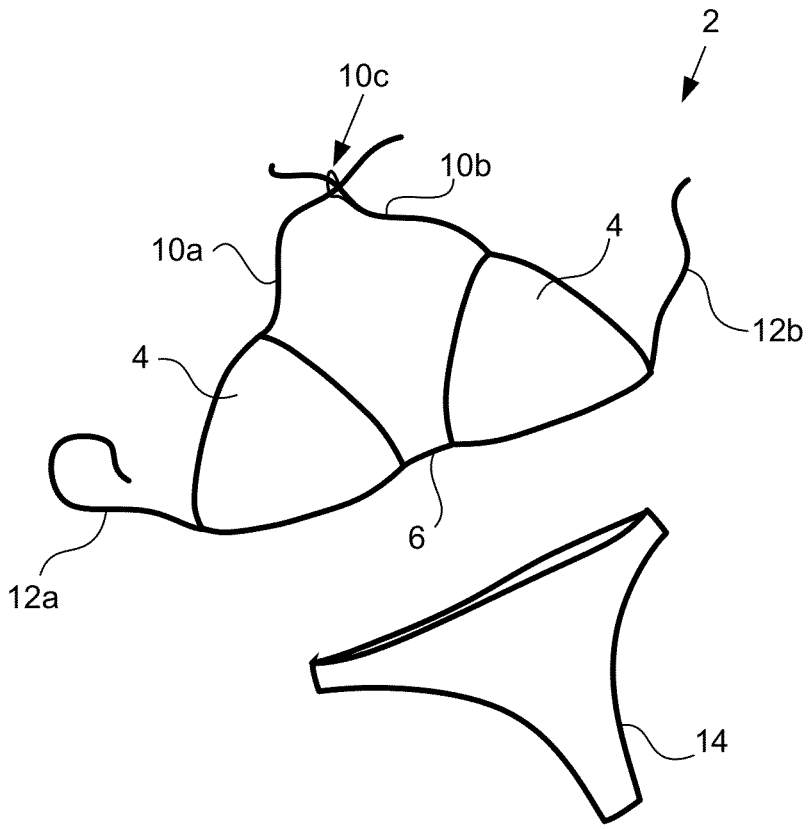
FIG. 1 illustrates an example of a known bathing suit.
Figure 2A:
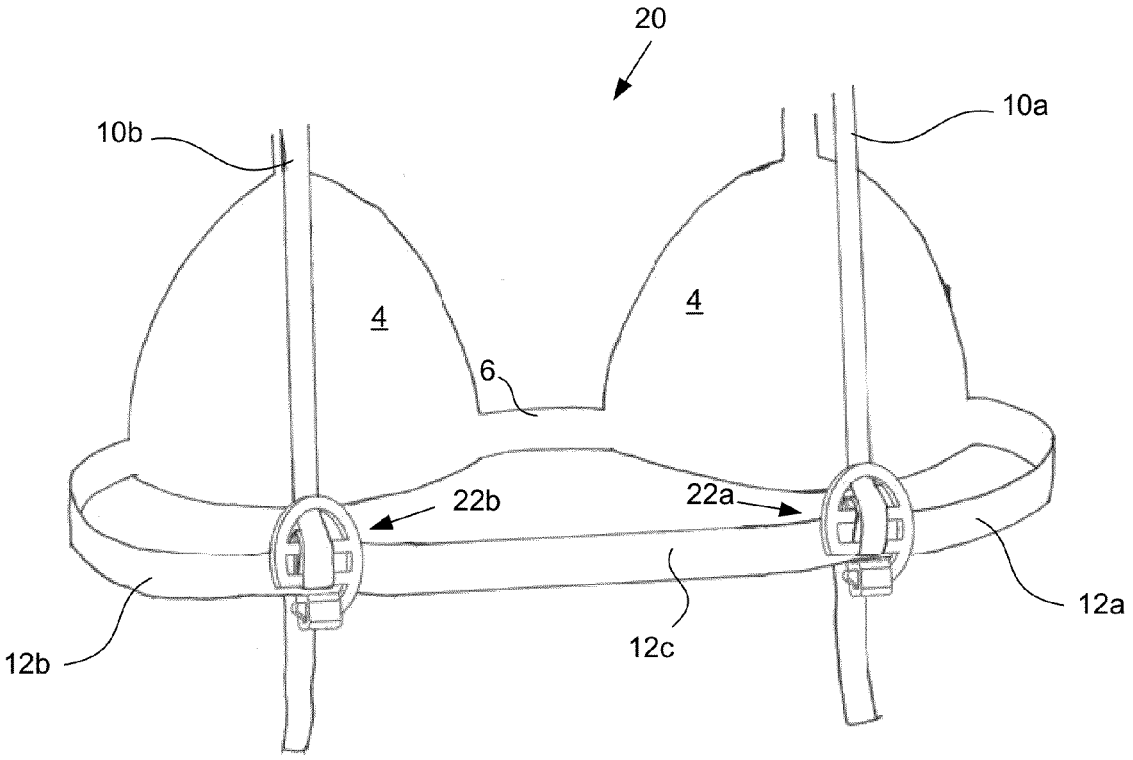
FIG. 2A illustrates an example of a system constructed according to one example of the disclosure.
Figure 2B:
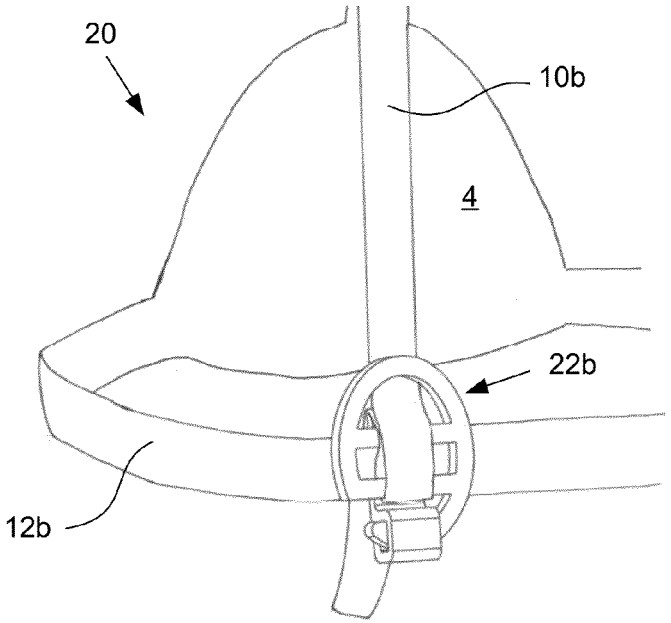
FIG. 2B illustrates a close-up view of one of the DSIs shown in FIG. 2A.

The current disclosure is directed to a variety of systems, detachable-strap-interfaces (DSI) and related methods. FIGS. 2A and 2B illustrate an example of a convertible garment system 20 for a user. System 20 may include a variety of bathing suits or other garments that are known in the art, e.g., any variety of halter tops that connect behind the neck of the user. For purposes of illustration and understanding, system 20 will share some of the call-out numbers used to describe the suit in FIG. 1. System 20 includes a pair of breast cups 4 connected on their front by strap 6. A pair of lower straps 12*a* and 12*b* are connected to the pair of breast cups and extendable laterally for connecting behind the back of the user in area 12*c*, using a bow, knot, clip, etc.

Pair of upper straps 10*a* and 10*b* are connected to the breast cups and extend upwardly. In contrast to FIG. 1, however, where straps 10*a* and 10*b* connect in a knot or bow around the neck of the user, straps 10*a* and 10*b* do not connect behind the neck of a user, but extend over a user's shoulders to connect to detachable-strap-interfaces (DSI) 22*a* and 22*b*. DSIs are configured to removably connect to the lower straps 12*a* and 12*b* and removably connect to the upper straps 10*a* and 10*b*. The result is a second configuration for the pair of upper straps, which reduces load bearing on the neck and acute pressure created by knot 10*c* behind the user's neck (not present in the second configuration).

Figure 3:
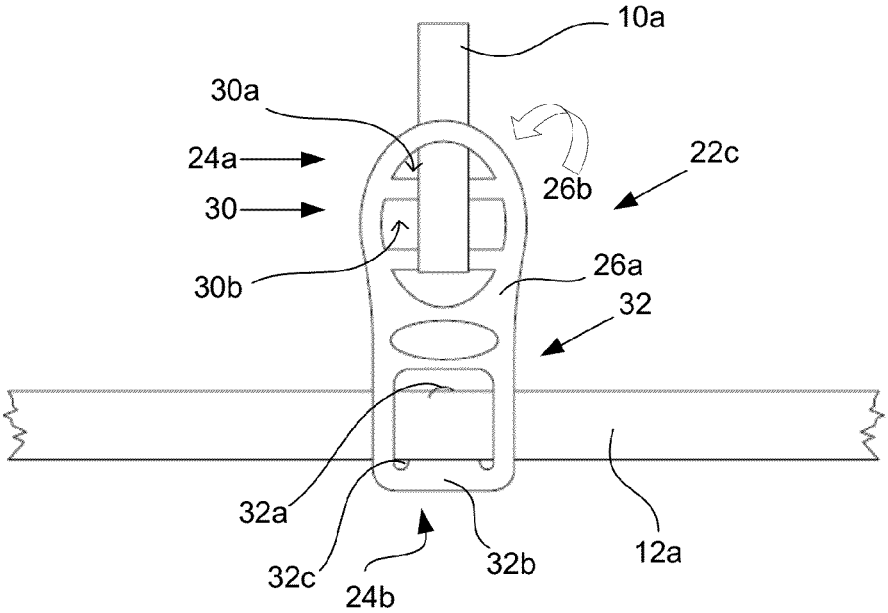
FIG. 3 illustrates a close-up view of another example of a DSI.

FIG. 3 illustrates a close-up view of one embodiment example of a DSI, which may be considered DSI 22*c*. DSI 22*c* includes a buckle-end 24*a* and channel-portion 24*b*. DSI may also be considered to have a body side (BS) and an away side (AS). In FIG. 3, side 26*a* is the BS and the opposite side, 26*b*, is the AS, however, relative positioning may vary. Upper strap 10*a* is removably connected at the buckle-end 24*a* of the DSI and the lower strap 12*a* is removably connected at the channel-portion 24*b* of the DSI.

Connection at the buckle-end may be achieved in a variety of ways, for example, using at least one aperture 30 configured to attach to at least one of the pair of upper straps by threading the straps through at least one aperture. In this example, apertures 30 include an upper aperture 30*a* and lower aperture 30*b* to facilitate securing straps. Additional apertures may be used to provide various levels of adjustment or mending of the tag end of the strap. It should be clear, that aperture shape may vary from example to example. Additionally, some buckle-ends are considered to include other configurations for attachment, e.g. clamps, clips, etc. for connecting to at least one upper strap.

Connection at the channel-portion may similarly be achieved in a variety of ways, for example, using a channel, e.g., channel 32. Channel 32 includes a top end 32*a* and a lower end 32*b*, and is openable at its top end, thereby allowing at least one of the lower straps to be received by the channel. Channel 32 is closed at its lower end 32*b*, thereby creating shelf 32*c*. Shelf 32*c* transfers the downward pressure of the user's breast from the user's neck to the lateral straps, thereby allowing the user to optionally employ a second configuration as needed. Channels may additionally be biased to provide a clamping force, for example, as illustrated.

Figure 4:
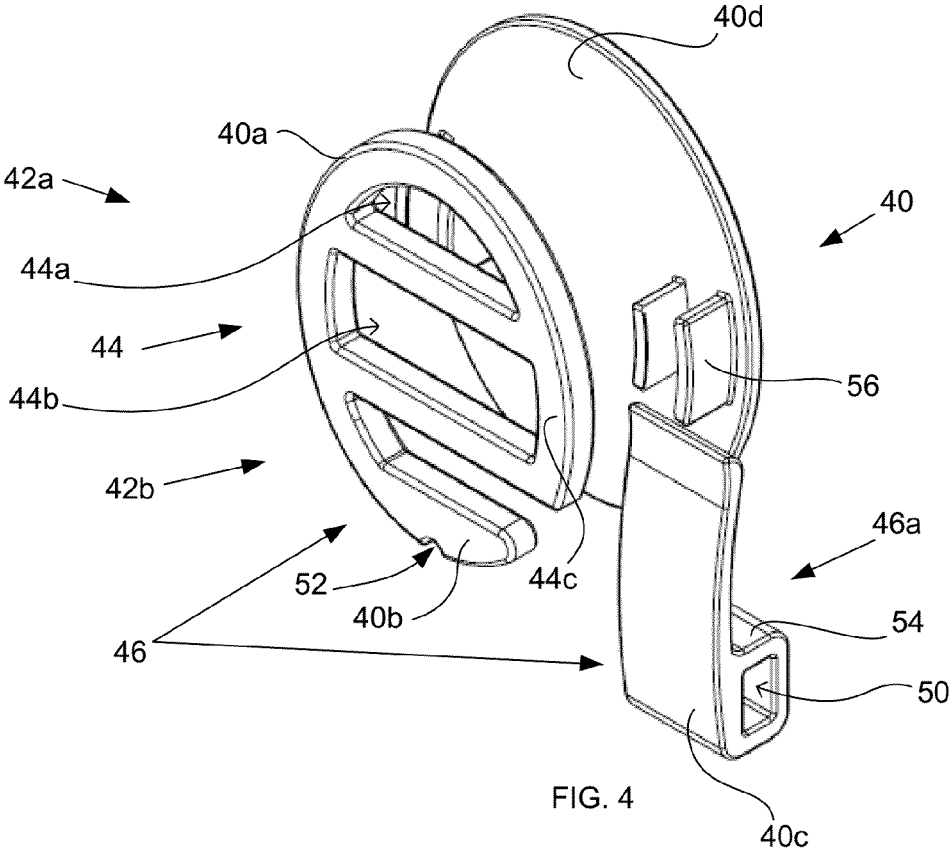
FIG. 4 illustrates another example of a DSI.

FIG. 4 illustrates an exploded view of another DSI embodiment example, which may be considered similar to the DSI shown in FIGS. 2A and 2B. DSI 40 includes a buckle-end 42*a* and a channel-portion 42*b*. DSI 40 is configured such that an upper strap can removably connect at the buckle-end, and such that a lower strap can removably connected at the channel-portion. In this example, DSI 40 includes a base plate 40*a* defining a finger 40*b*, a channel arm 40*c*, and an optional face plate 40*d*. Pieces 40*a*, 40*c* and 40*d* may be readily manufactured and assembled to create the functional DSI. Base plate 40*a* may also include an upper arm 43 formed between and upper aperture 44*a* and a lower aperture 44*b*. An open aperture 47 is defined on one side by a side arm 44*c*, above by lower arm 45 and below by finger 40*b*. The upper arm 43 and the lower arm 45 are parallel to each other between the side arms 44*c*. Finger 40*b* projects horizontally between the side arms 44*c* and includes non-parallel upper and lower sides with the finger being partially rounded on at least one side.

Base plate 40*a* defines at least one aperture configured to attach to at least one of the pair of upper straps. For example, attachment may be achieved by threading the straps through upper aperture 44*a* and lower aperture 44*b*. Connection at the lower end may be achieved using channel 46. Channel 46 is formed by channel arm 40*c* and base plate 40*a*. As seen, channel arm 40*c* defines an aperture 50 for receiving finger 40*b*. Channel arms may lock in place using a variety of techniques, e.g. adhesive, sonic welding, etc. In the example depicted, the channel arm snaps into place using friction created by an internal projection (not shown) shaped to be received by recess 52. The channel arm 40*c* having a length, as shown in FIG. 4, that extends above the lower arm 45 of the buckle end 42*a* towards the lower aperture 44*b* when the channel arm is mated with the base plate 40*a* in order to create the channel 46 for securing said one of the lower back straps. The upper end of the resultant channel creates a channel passageway which is open for receiving at least one lower strap. Channel shelf 54, for applying upward pressure to the lower straps, is also visible in this figure.

Face plate 40*d* may optionally attach to the base plate. Face 40*d* may serve a variety of functions, e.g., concealing the threaded or channeled straps, distributing pressure over a wider surface of the back, providing advertising indicia, providing a variety of colors or shapes to better coordinate with existing suits, etc. Somewhat similarly, base plate shapes may be a variety of ornamental shapes as well. In the example shown, face plate 40*d* includes projections 56 configured to interface with side arms 44*c* of lower aperture 44*b*. Accordingly, side arms 44*c* are shaped to interface with projections 56. In other examples, faces may interface in other ways, e.g., using projections at various positions to interface with other parts of the base plate.

Figure 5A:
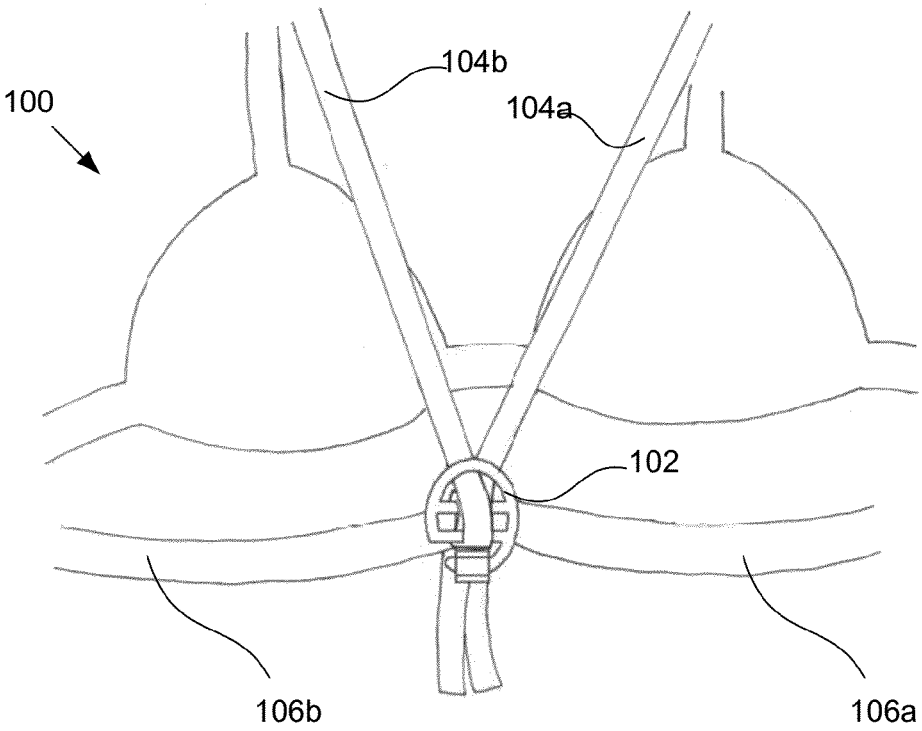
FIGS. 5A and 5B illustrate additional system configurations.
Figure 5B:
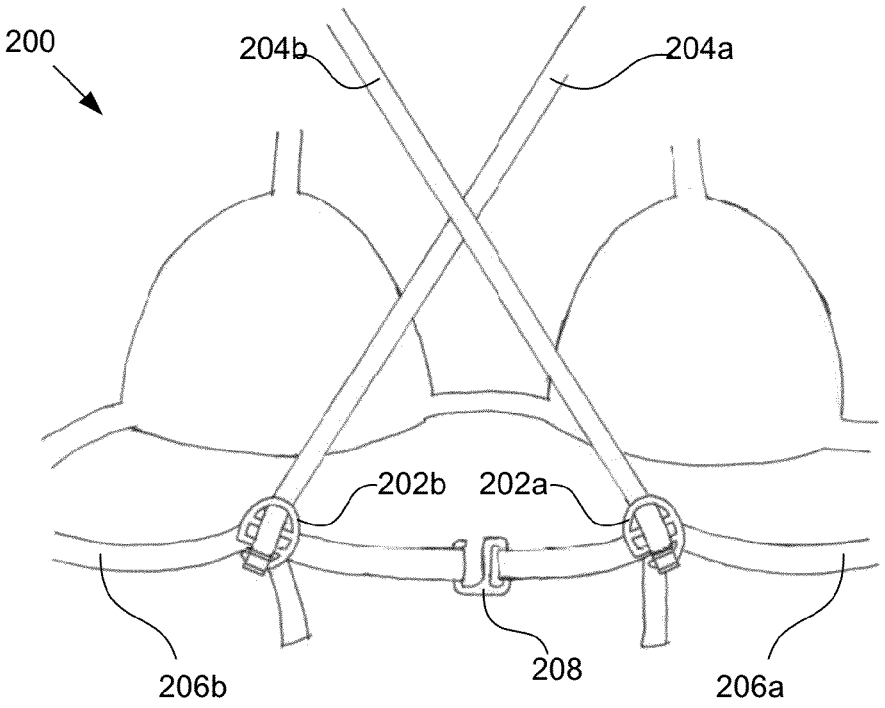

Using any of the DSIs disclosed herein, a variety of second configurations may be achieved. FIG. 5*a*, for example, illustrates another system 100 in a second configuration where a single DSI 102 is removably connected to both upper straps 104*a* and 104*b*. DSI 102 is also removably connected to lower strap 106*a* and could alternatively be connected to strap 106*b*, or to both straps 106*a* and 106*b*. FIG. 5*b* illustrates another system 200 in a second configuration where a pair of DSI 202*a* and 202*b* are removably connected to upper straps 204*a* and 204*b*. In this example, however, strap 204*a* and 204*b* are crossed such that strap 204*a* is connected to DSI 202*b*, and strap 204*b* is connected to DSI 202*a*. DSIs are removably connected to lower straps 206*a* and 206*b*. Clasp 208 is also illustrated, but lower straps may be connected in other ways as noted previously.

Figure 6A:
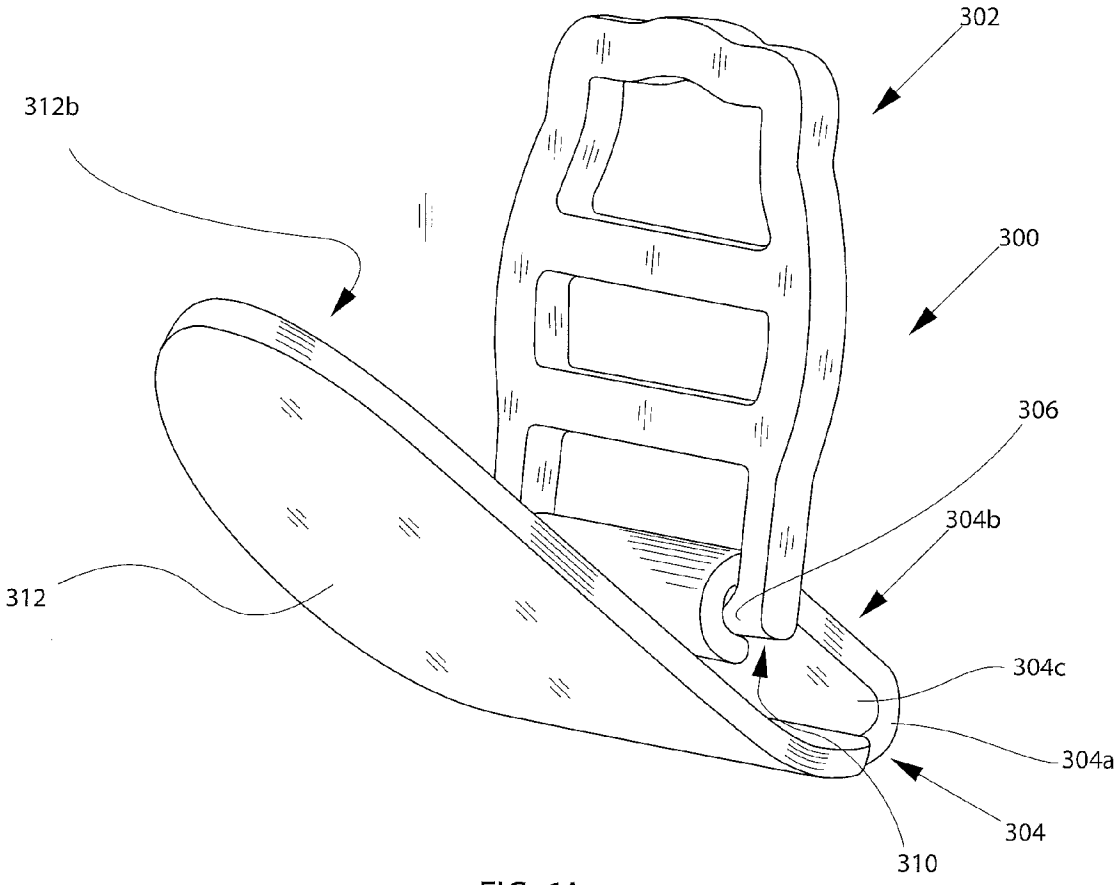
FIGS. 6A, 6B, and 6C illustrate another example of a DSI.
Figure 6B:
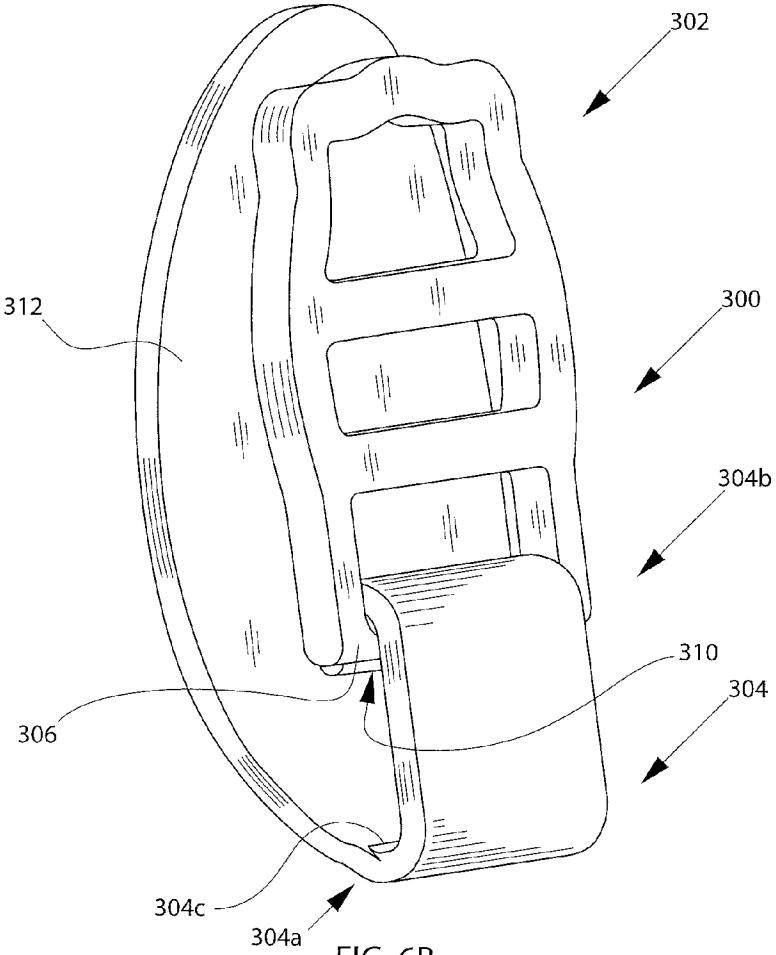
Figure 6C:
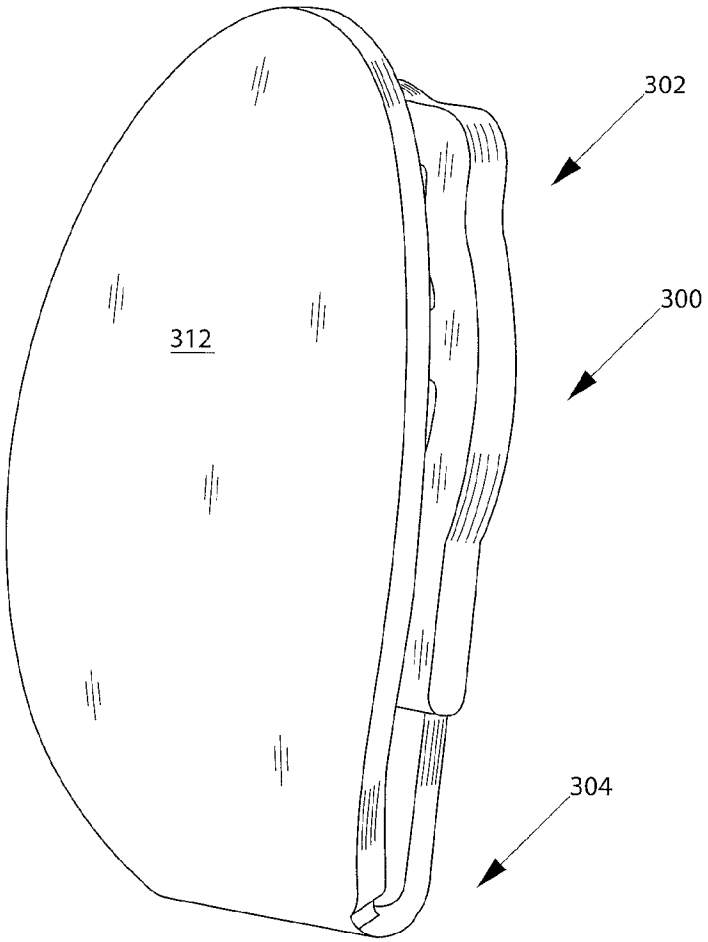

FIGS. 6A, 6B, and 6C illustrate various views of DSI 300, another DSI embodiment example. DSI 300 includes a buckle-end 302 configured to attach to at least one of the upper straps. DSI 300 also includes a channel-portion 304 having a lower end 304*a* and a top end 304*b* positioned above the lower end. Channel 304 also includes shelf 304*c* for applying upward pressure to at least one of the lower straps. This example differs somewhat from previous examples for at least the reason that the channel-portion is pivotally attached to the buckle-end. In such examples, the buckle-end can readily be attached to an upper strap of a suit or garment, and the channel-portion can be pivoted open, similar to the view seen in FIG. 6A, thereby creating a self guiding structure that guides the lower strap of the suit or garment into the channel. Once the lower strap has been received by the channel, the DSI may be closed similar to the illustration in FIG. 6B. The upward force created by the upper strap attached to the buckle, and the downward force created by the lower strap received by the channel also facilitate the closed position of the DSI when in use.

Pivotal attachment may be achieved in a variety of ways. In this example, base plate 302 includes a pivot bar 306, which is received by a pivot recess 310 of channel plate 302. Pivotal attachment may be received by a variety of different hinge-type structures or may be achieved by the use of resilient material.

Channel plates may also include a cover, e.g., cover 312 extending upwardly from channel 304. Covers will typically be distally positioned relative to the user, e.g., to cover the strap, buckle, etc. Covers may also provide some self-guiding function as their back side 312*b* provides a surface over which lower straps may travel in route to channels. In many examples, covers will have a height that is sufficient to cover the base plate or buckle, but in other examples, covers may have lesser heights.

Figure 7A:
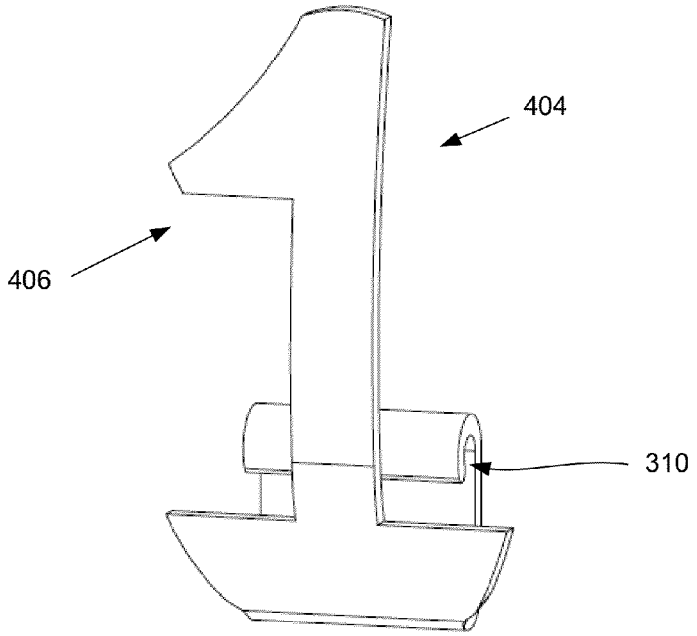
FIGS. 7A and 7B illustrate DSI channel plate examples.
Figure 7B:
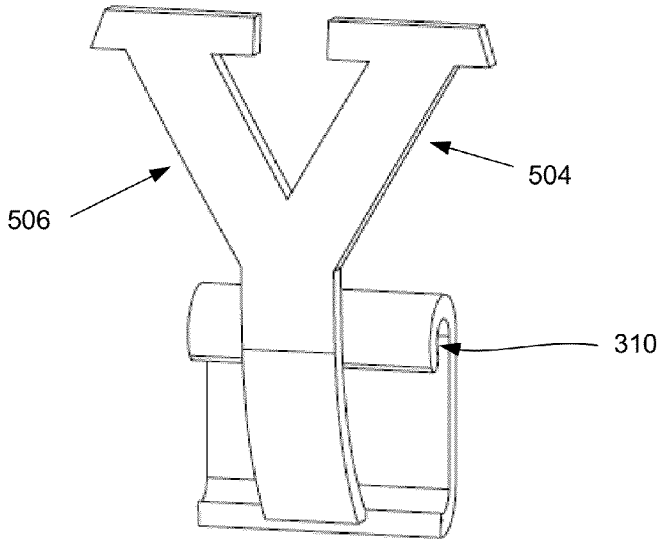

Covers may also include any combination of ornamentation or advertising indicia. FIGS. 7A and 7B for example, illustrate channel plates 404 and 504, which may be pivotally attached to base plate 302 by interfacing pivot bar 306 with pivot recesses 310. As seen, covers 406 and 506 have ornamentation.

Figure 8:
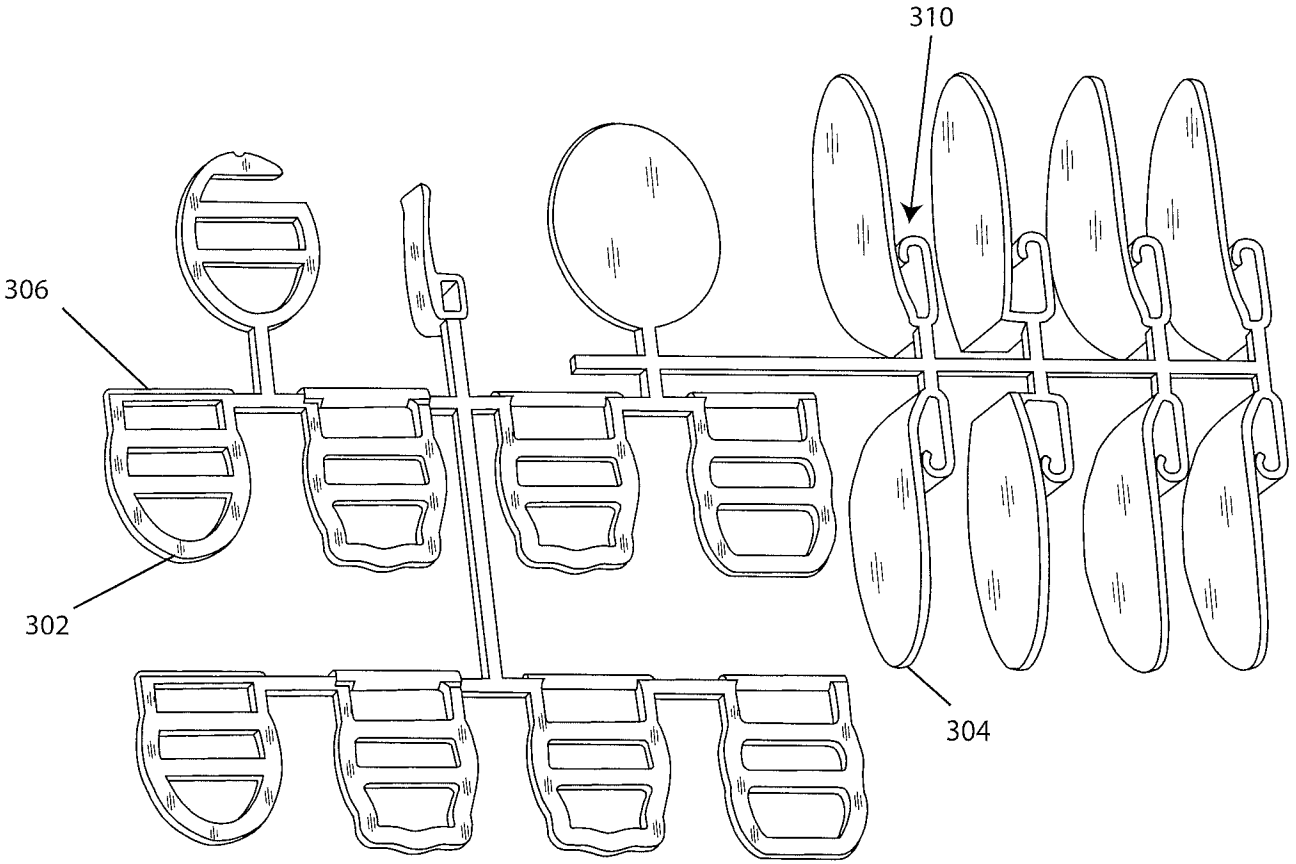
FIG. 8 illustrates a manufacturing layout example.

FIG. 8 illustrates an example of various parts of DSI described above in a manufacturing layout.

Figure 9:
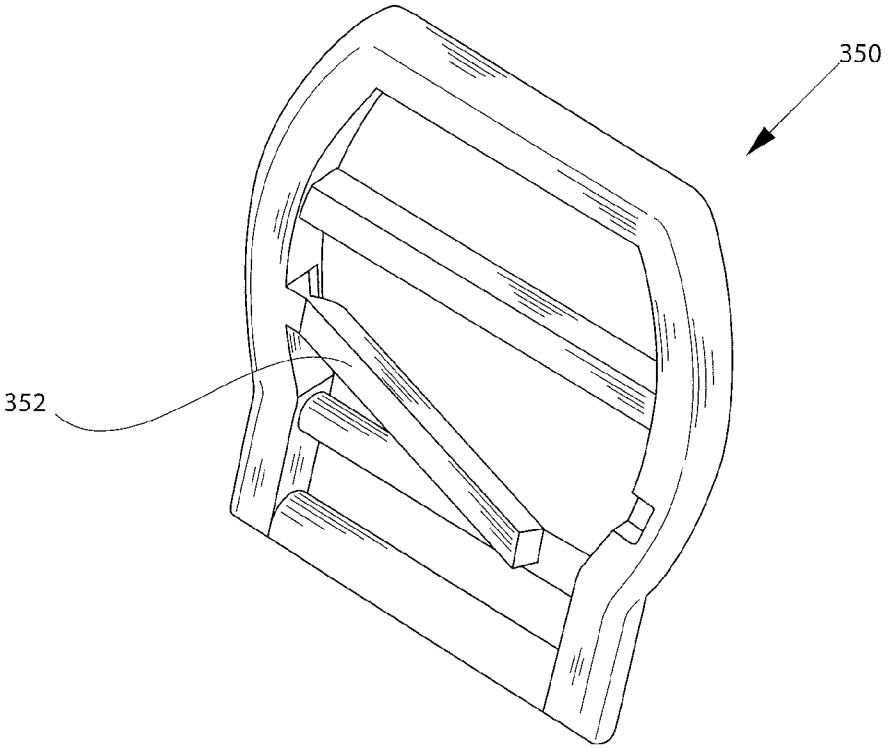
FIG. 9 illustrates another example of a DSI buckle-end.

FIG. 9 illustrates another buckle-end example, referred to as 350, including resilient arm 352, which may further define an aperture. Resilient arms may further secure straps attached to the buckle-end.

Figure 10:
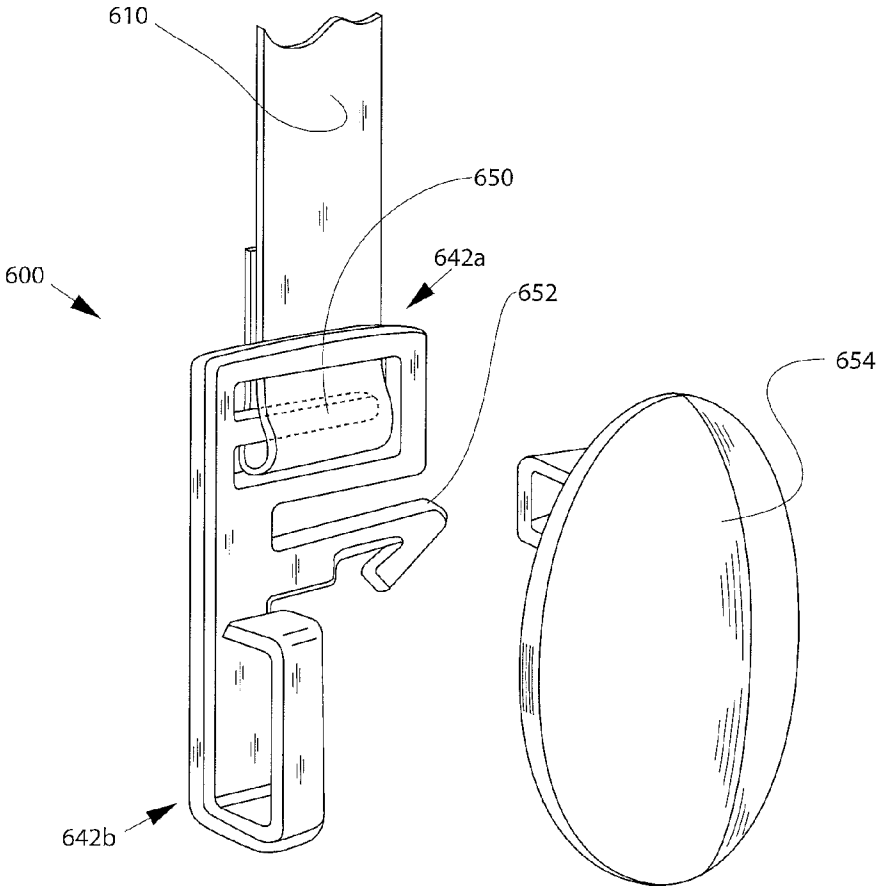
FIG. 10 illustrates another example of a DSI.

FIG. 10 illustrates another DSI embodiment example 600. DSI 600 includes buckle-end 642*a* and channel-portion 642*b*. An upper strap 610 is seen interfaced with buckle-end 642*a*. In this example, buckle-end 642*a* also includes a resilient arm 650 to further secure strap 610. DSI 600 also includes a cover interface 652 for interfacing with cover 654. Covers may vary from example to example, e.g. they may be ornamental as described previously. Covers may also provide an additional clamping force in some examples.

Figure 11:
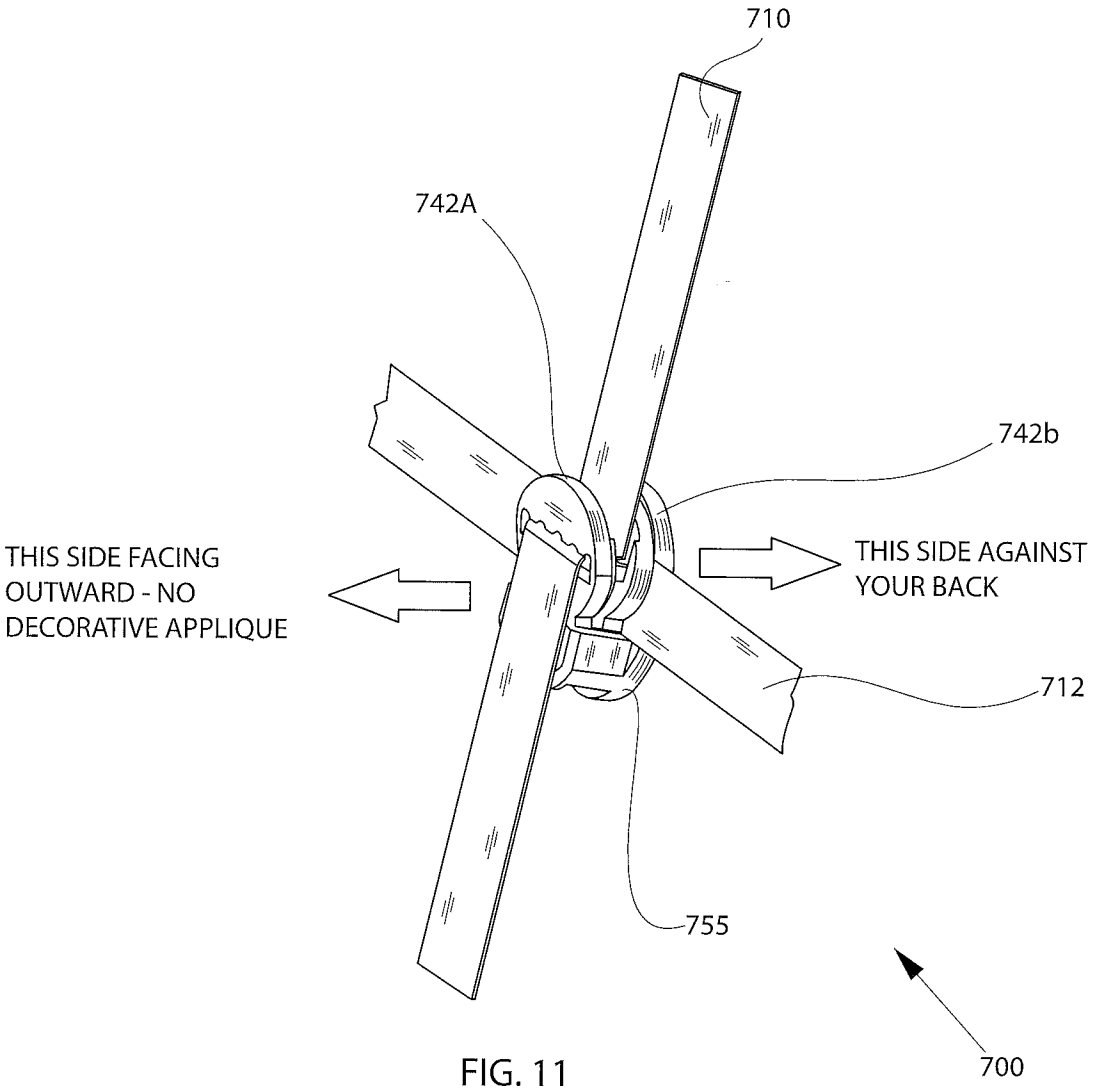
FIG. 11 illustrates another example of a DSI.

FIG. 11 illustrates another DSI example 700, interfaced at buckle-end 742*a* with an upper strap 710, and interfaced at channel-portion 742*b* with a lower strap 712. In this example, buckle-end 742*a* includes a single aperture configured to secure the upper strap. DSI 700 also includes a flat surface 755 for positioning against the user's body. Surface 755 may be cushioned in some examples.

Figure 12:
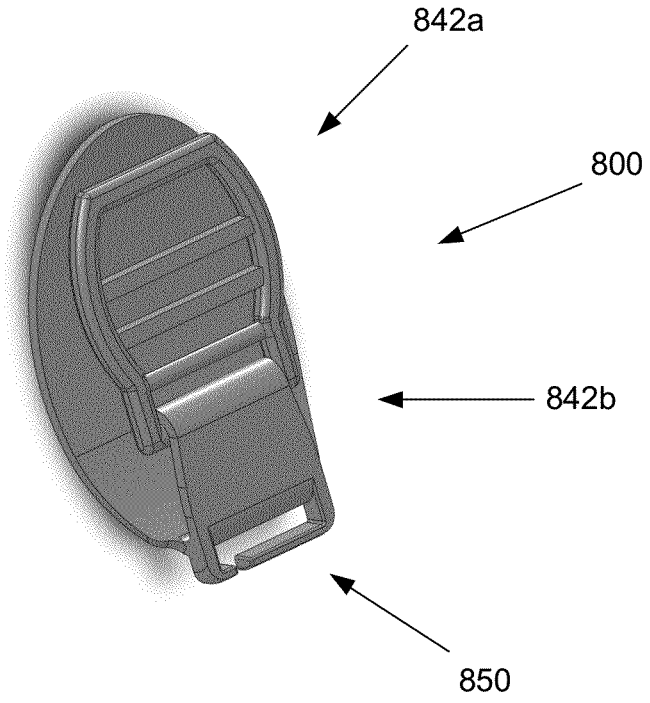
FIGS. 12 and 13 illustrate another example of a DSI.
Figure 13:
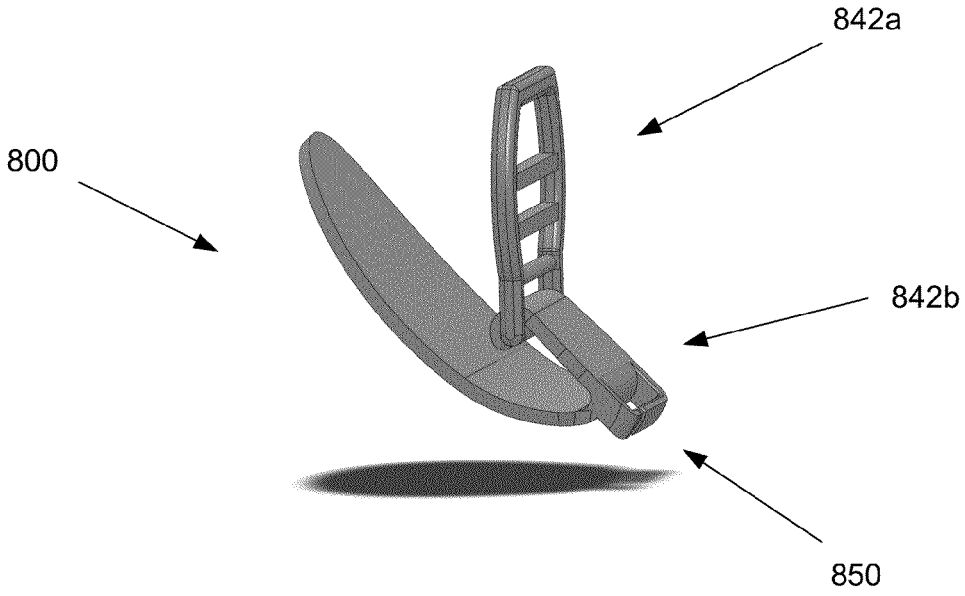

FIGS. 12 and 13 illustrate another DSI embodiment example 800. DSI 800 includes buckle-end 842*a* for interfacing with at least one upper strap, and a channel-portion 842*b* for interfacing with at least one lower strap. DSI 800 further includes a secondary aperture 850. In this example, the secondary aperture is positioned below the channel shelf, but other examples, it may be positioned in other ways. Secondary apertures are useful for, inter alia, securing the tag end of an upper or lower strap.

Figure 14:
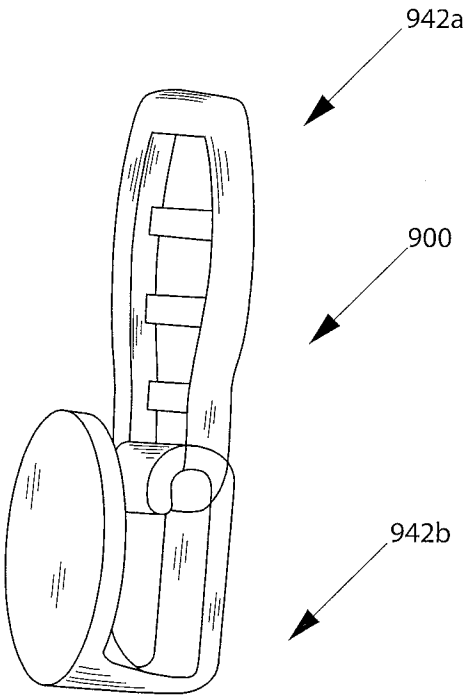
FIG. 14 illustrates another example of a DSI.

FIG. 14 illustrates another DSI embodiment example 900. DSI 900 includes buckle-end 942*a* for interfacing with at least one upper strap, and a channel-portion 942*b* for interfacing with at least one lower strap. DSI 900 is somewhat similar to DSI 300 previously described.

Figure 15:
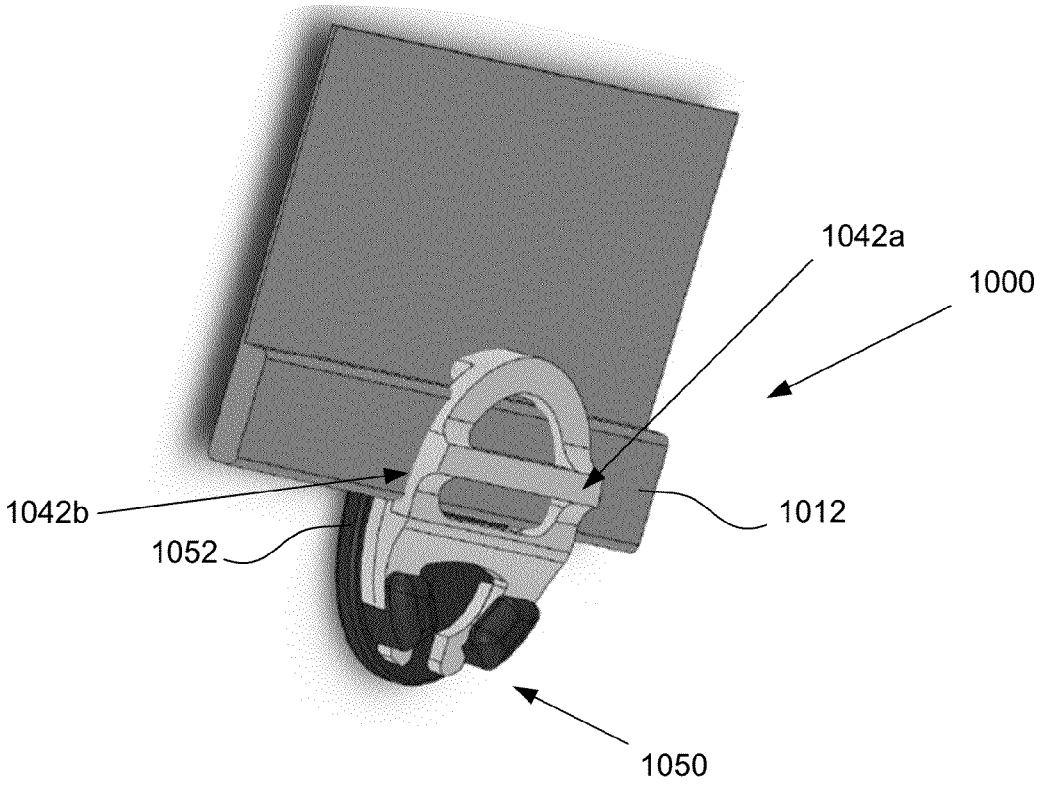
FIG. 15 illustrates another example of a DSI.

FIG. 15 illustrates another DSI embodiment example 1000. DSI 1000 includes buckle-end 1042*a* for interfacing with at least one upper strap (not shown), and a channel-portion 1042*b* for interfacing with at least one lower strap (1012). Channel-portion 1042*b* is defined, in part, by plate 1052 which clipably interfaces at portion 1050.

Figure 16:
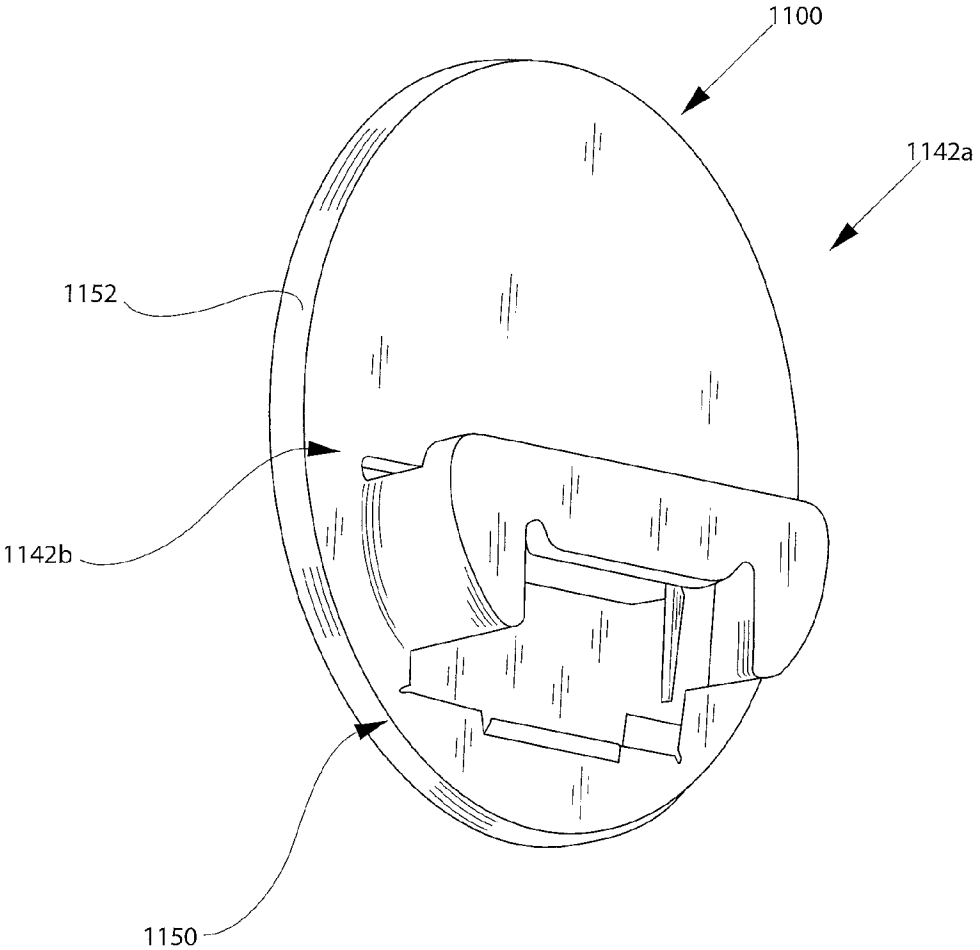
FIG. 16 illustrates another example of a DSI.

FIG. 16 illustrates another DSI embodiment example 1100. DSI 1100 includes buckle-end 1142*a* for interfacing with at least one upper strap (not shown), and a channel-portion 1142*b* for interfacing with at least one lower strap (not shown). Channel-portion 1142*b* is defined, in part, by plate 1152 which clipably interfaces at portion 1150, similarly to DSI 1000.

Figure 17:
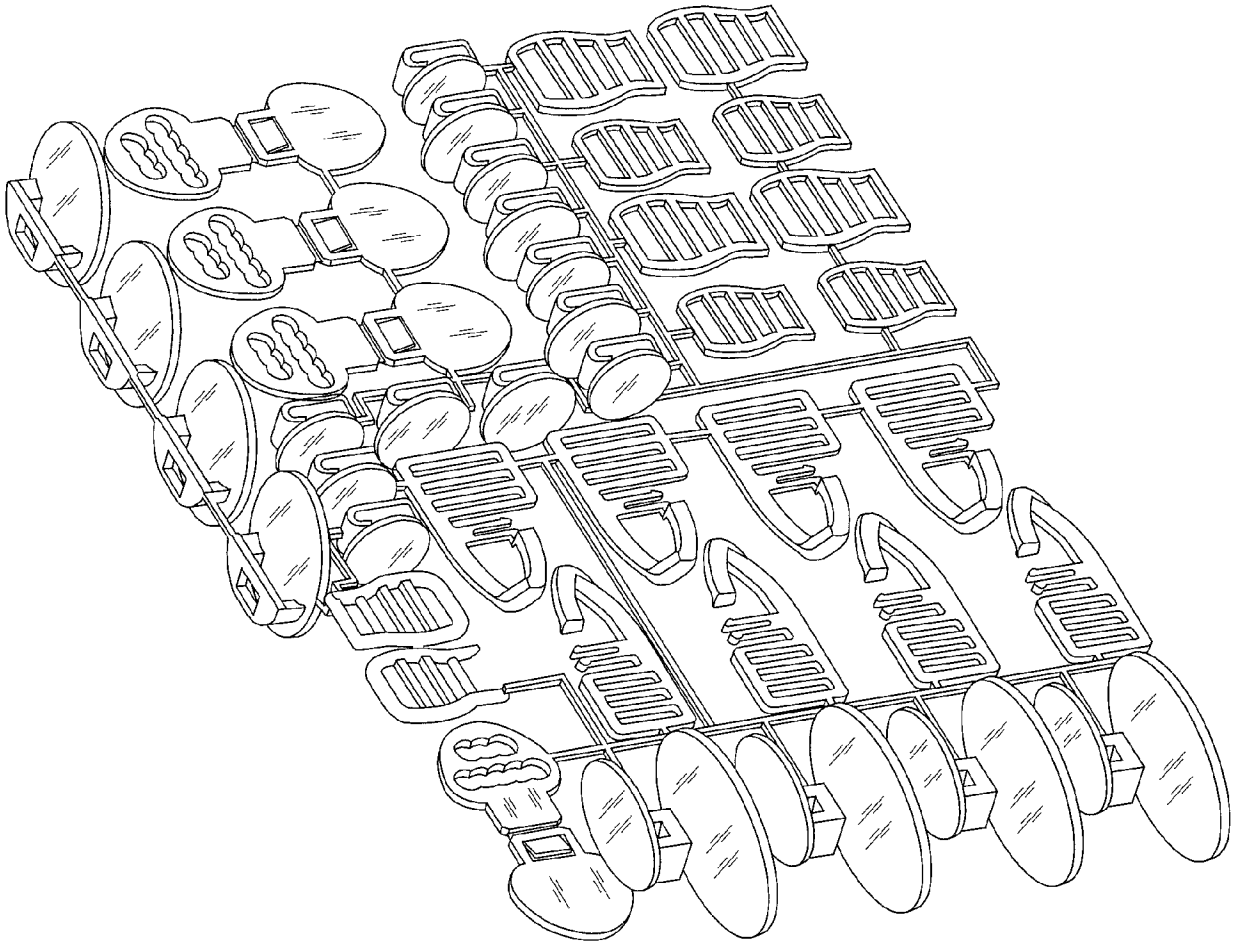
FIG. 17 illustrates another manufacturing layout example.

FIG. 17 illustrates another example of various DSI parts as manufactured.

Figure 18:
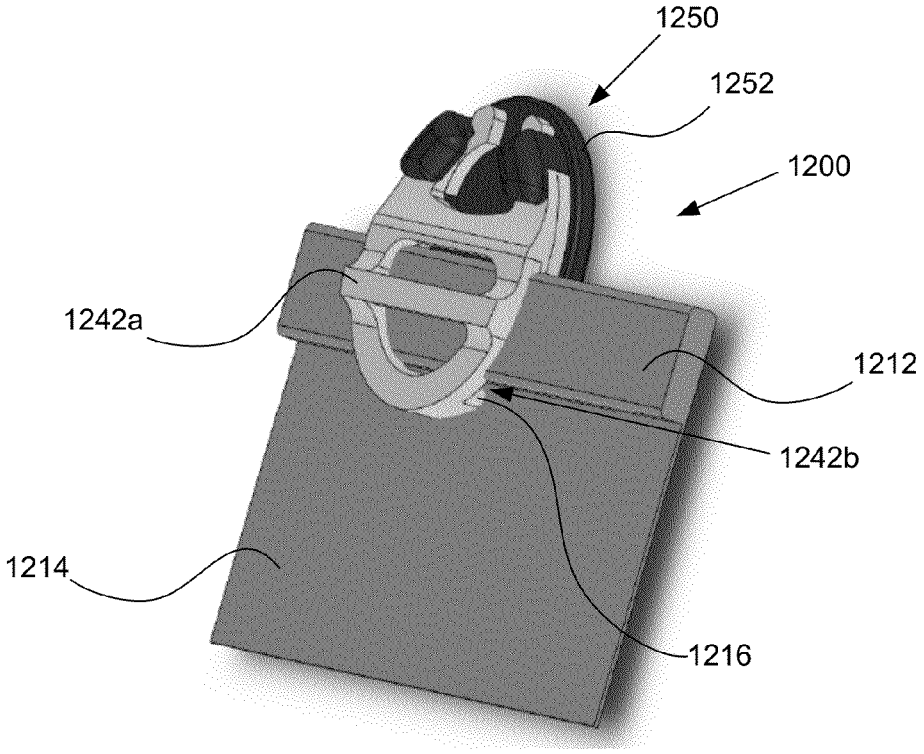
FIG. 18 illustrates another example of a DSI.

FIG. 18 illustrates another DSI embodiment example 1200. DSI 1200 includes buckle-end 1242*a* for interfacing with at least one upper strap (not shown), and a channel-portion 1242*b* for interfacing with at least one lower strap. In this example, the channel-portion is open at its bottom end, as seen, and lower strap 1212 includes the selvedge or edge of a garment 1214, e.g. a halter-top or tube-top style garment. In this type of example, the DSI uses a clamping force to secure the lower strap. The DSI may similarly include a shelf 1216 to increase purchase on the lower strap. Clamping force may be facilitated, at least in part, by plate 1252, which clipably interfaces at portion 1250. In this example, the clipable interface at portion 1250 acts as a biasing hinge to provide clamping force, but other examples, may include springs, or other structures to provide and inward clamping force.

It should be clear from the above disclosure that systems and DSI disclosed herein encompass a variety of embodiments, the parts of which are not considered to mutually exclusive, e.g. DSI structure may be exchanged amongst the various embodiments, any of the DSI examples may be used with various systems, etc.

The current disclosure is also directed to methods of converting garments to a second configuration. In one example, a method includes obtaining any of the garments mentioned above, attaching one of the pair of upper straps to any of the DSIs mentioned above, and attaching the DSI to at least one of said pair of lower straps. Methods may also include attaching additional DSI.

Numerous characteristics and advantages have been set forth in the foregoing description, together with details of structure and function. The disclosure, however, is illustrative only, and changes may be made in detail, especially in matters of shape, size, and arrangement of parts, within the principle of the invention, to the full extent indicated by the broad general meaning of the terms in which the general claims are expressed.

What is claimed is:

1. A convertible garment system adapted for a wearer, the system comprising:

a garment configured to be worn on an upper torso area of the wearer having a pair of upper shoulder straps connected to the garment and extendable upwardly for connecting the upper shoulder straps to one another adaptively to be behind a neck of the wearer in a first configuration, a pair of lower back straps connected to the garment and extendable laterally for connecting at a position adaptively below the neck and behind a back of the wearer; and at least one detachable strap interface for creating a second configuration, wherein the pair of upper shoulder straps are unconnected from each other so that each of the upper shoulder straps can be removably attached to the pair of lower back straps at a position below the neck and behind the back of the wearer in the second configuration, the second configuration reducing load bearing and acute pressure on the neck of the wearer created by the pair of upper shoulder straps in the first configuration, the at least one detachable strap interface comprising:

a base plate for receiving one of the pair of upper shoulder straps and one of the pair of lower back straps of the convertible garment system, the base plate including:

a buckle-end defining an upper aperture and a lower aperture, the upper and lower apertures separated by an upper arm and framed on each side by side arms, wherein the upper aperture is configured to receive said one of the pair of upper shoulder straps of the garment adaptively from one shoulder of the wearer, a lower arm situated below the lower aperture and between the side arms; and a channel-portion defining a finger extending from at least one of the side arms, an open aperture separating the finger from the lower arm, wherein the open aperture is configured to receive said one of the pair of upper shoulder straps of the garment from the upper aperture and the lower aperture is configured to receive said one of the pair of upper shoulder straps of the garment from the open aperture;

a channel arm including:

a channel shelf, and a channel aperture within the channel shelf and shaped to accept the finger of the channel-portion, and wherein the channel arm mates with the base plate by an interface between the finger and the channel aperture when the channel aperture receives the finger of the channel-portion, the channel arm having a length that extends above the lower arm of the buckle end towards the lower aperture when the channel arm is mated with the base plate in order to create a channel passageway for securing said one of the lower back straps, the channel passageway being formed above the channel shelf and between the channel arm and the lower arm;

the channel shelf capable of applying upward pressure to said one of the lower back straps when said one of the lower back straps is received within the channel passageway.

2. The at least one detachable strap interface of claim 1 including a face plate.

3. The at least one detachable strap interface of claim 2 wherein the face plate includes at least one projection for securing the face plate to the base plate.

4. The at least one detachable strap interface of claim 3 wherein the at least one projection mates with at least one of the side arms to secure the face plate to the base plate.

5. The at least one detachable strap interface of claim 1 wherein the upper arm and the lower arm are parallel with each other between the side arms.

6. The at least one detachable strap interface of claim 5 wherein the finger projects horizontally between the side arms.

7. The at least one detachable strap interface of claim 6 wherein the finger includes non-parallel upper and lower sides.

8. The at least one detachable strap interface of claim 6 wherein the finger is partially rounded on at least one side.

9. The at least one detachable strap interface of claim 1 wherein the finger includes a recess.

10. The at least one detachable strap interface of claim 9 further including an internal projection inside of the channel aperture, wherein the internal projection aligns with the recess when the finger and channel aperture are interfaced.

11. A method of enabling a convertible garment system, the method comprising:

obtaining a garment configured to be worn on an upper torso area of a wearer having a pair of upper shoulder straps connected to the garment and extending upwardly for connecting the upper shoulder straps to one another adaptively to be behind a neck of the wearer in a first configuration, a pair of lower back straps connected to the garment and extending laterally for connecting at a position adaptively below the neck and behind a back of the wearer;

converting the garment from the first configuration with the pair of upper shoulder straps securing to each other behind the wearer's neck to a second configuration wherein each of the upper shoulder straps unconnect from each other to extend across the wearer's shoulders to secure to at least one detachable-strap-interface and to the pair of lower back straps at a position below the neck and behind the back of the wearer, the second configuration reducing load bearing and acute pressure on the neck of the wearer created by the pair of upper shoulder straps in the first configuration, the at least one detachable-strap-interface in the second configuration comprising:

a base plate receiving one of the pair of upper shoulder straps and one of the pair of lower back straps of the convertible garment system, the base plate including:

a buckle-end defining an upper aperture and a lower aperture, the upper and lower apertures separated by an upper arm and framed on each side by side arms, wherein the upper aperture receiving said one of the pair of upper shoulder straps of the garment adaptively from one of the shoulders of the wearer, a lower arm situated below the lower aperture and between the side arms; and a channel-portion defining a finger extending from at least one of the side arms, an open aperture separating the finger from the lower arm, wherein the open aperture receiving said one of the pair of upper shoulder straps of the garment from the upper aperture and the lower aperture receiving said one of the pair of upper shoulder straps of the garment from the open aperture;

a channel arm including:

a channel shelf, and a channel aperture within the channel shelf shaped to accept the finger of the channel-portion, and wherein the channel arm mating with the base plate by an interface between the finger and the channel aperture by the channel aperture receiving the finger of the channel-portion, the channel arm having a length extending above the lower arm of the buckle end towards the lower aperture upon the channel arm mating with the base plate creating a channel passageway for securing said one of the lower back straps, the channel passageway forming above the channel shelf and between the channel arm and the lower arm;

receiving said one of the lower back straps between the channel arm and the lower arm through the channel passageway, the channel shelf capable of applying upward pressure to said one of the lower back straps via the channel passageway.

12. The method of claim 11 including locking the channel arm in place by interfacing a projection inside the channel aperture with a recess on the finger.

13. The method of claim 11 including attaching a face plate to the base plate.

14. The method of claim 13 including aligning one of the side arms of the base plate with a set of projections extending from the face plate.

* * * * *